United States Patent [19]

Quaggiotto

[11] 4,244,444

[45] Jan. 13, 1981

[54] WALKING STEPLADDER

[76] Inventor: Giovanni N. Quaggiotto, 400 NE. 137th St., North Miami, Fla. 33161

[21] Appl. No.: 84,685

[22] Filed: Oct. 15, 1979

[51] Int. Cl.[3] ..... E04G 1/18

[52] U.S. Cl. ..... 182/104; 182/116; 182/165

[58] Field of Search ..... 182/104, 165, 173, 153, 182/186, 116, 226

[56] References Cited

U.S. PATENT DOCUMENTS

| | | | |
|---|---|---|---|
| 300,846 | 6/1884 | Chatfield | 182/165 |
| 302,040 | 7/1884 | Shumway | 182/165 |
| 1,467,245 | 9/1923 | Anlauf | 182/165 |
| 2,317,444 | 4/1943 | Dalton | 182/226 |
| 3,289,789 | 12/1966 | Larson | 182/186 |

FOREIGN PATENT DOCUMENTS

| | | | |
|---|---|---|---|
| 183215 | 3/1918 | Canada | 182/104 |

*Primary Examiner*—Reinaldo P. Machado
*Attorney, Agent, or Firm*—Ernest H. Schmidt

[57] ABSTRACT

A walking stepladder has a pair of substantially identical ladder sides, relatively hinged at the top, each side having step rungs for ascent or descent of the ladder from either side. In walking the ladder, the user straddles the ladder top with his legs supported by opposed rungs at each side of the ladder, and shifts his body weight from side to side while concurrently retracting and extending the ladder sides to effect stepwise ladder movement to one side or the other. Releasable means is provided for limiting inward or retracting movement of the relatively hinged ladder sides to prevent ladder instability or collapsing while being walked.

10 Claims, 10 Drawing Figures

WALKING STEPLADDER

My invention relates to stepladders and is directed particularly at improvements in walking stepladders of the type having substantially identical, relatively hinged stepladder sides which, upon use in walking of the ladder, are straddled from above and manipulated by body and leg movements to stepwisely move along the floor, to one side or the other.

Ordinary stepladders having stepping sides and supporting sides relatively hinged at the ladder top, and releasable spreader means maintaining the ladder in a proper and safe spread condition for use in climbing. Such ordinary stepladders are for use only by ascending the ladder step side, and can properly be moved from one position to another along the floor only after descending the ladder. Thus, when painting or otherwise working along upper wall surface portions of a room or building, for example, the user must frequently descend the ladder to replace it at an advanced position during progress of the work. If the work being done by its nature progresses at a rapid rate, this descending, replacing and ascending again consumes a substantial part of the time and effort involved in completing the job. For this reason, various designs of walking stepladders have heretofore been proposed, in which the user straddles the ladder sides from above the ladder top, using his body for weight shifting and his legs for concurrent scissor-like movement to spread and extend a ladder side for stepwise movement. It is the principal object of this invention to provide a novel and improved walking stepladder of the character above described wherein walking of the stepladder can be accomplished with minimal effort and maximum safety.

A more particular object of the invention is to provide an improved walking stepladder of the above nature wherein the ladder sides are substantially identical, and wherein the hinge means providing relative pivotal opening and closing of the ladder comprises releasable means for securely limiting relative inward movement of the ladder sides to a degree providing ladder stability while standing and at the same time allowing for sufficient inward movement as manipulated by body weight movement and leg movement, for rapid sideward walking of the ladder.

A more particular object of the invention is to provide hinge mechanisms in a walking stepladder that relies on metal-to-metal abutment with respect to the relatively pivoting hinge leaves, thereby insuring safety of operation, dependability, simplicity of construction and durability in use.

Another object is to provide a walking stepladder of the character described which will be of such heavy duty construction as renders it well suited for commercial or professional use as well as use in the house by the homeowner.

Other objects, features and advantages of the invention will be apparent from the following description when read with reference to the accompanying drawings. In the drawings, wherein like reference numerals denote corresponding parts throughout the several views.

Figure 10:
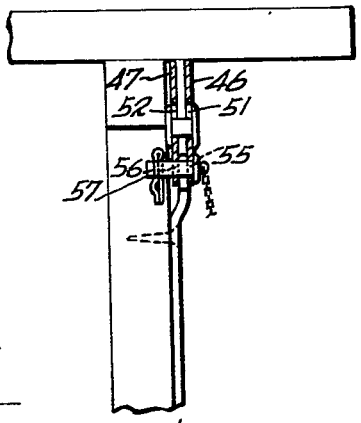
Figure 2:
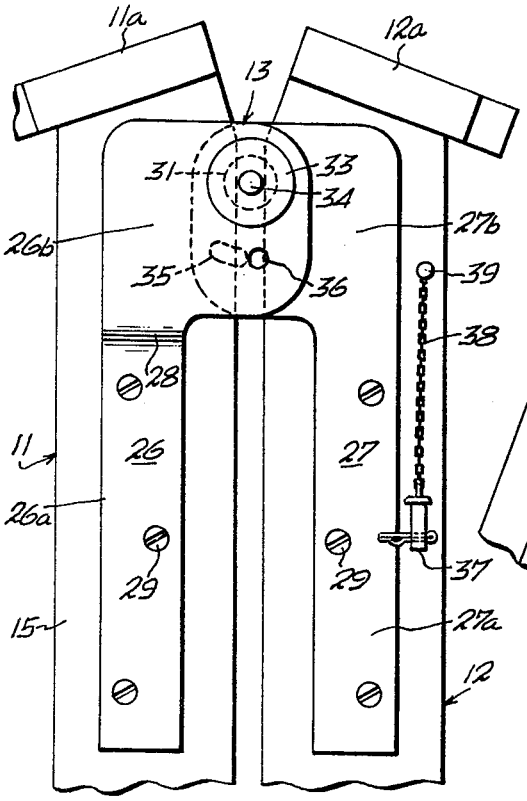
FIG. 2 is a partial side elevation view of the walking stepladder illustrated in FIG. 1, on an enlarged scale and illustrating constructional details of one of the side hinge mechanisms providing for full closure or folding together of the ladder sides for storage, or selective relative movement between fully opened and partially opened limit conditions for walking.
Figure 3:
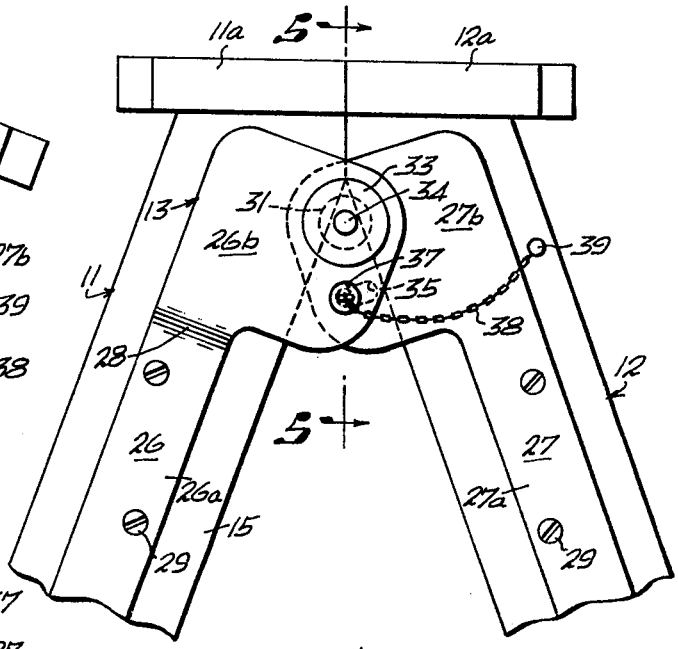
FIG. 3 is a side elevational view similar to that of FIG. 2 but showing the hinge mechanism opened and with the limited motion locking pin in place to prevent full collapsing of the ladder while walking.
Figure 8:
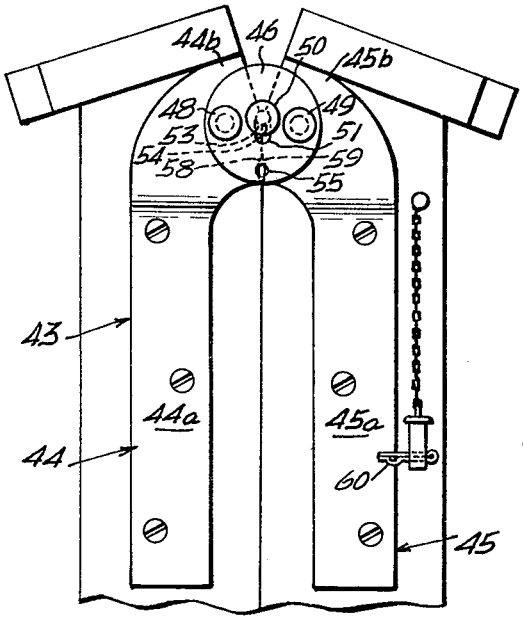
FIG. 8 is a side elevational view similar to that of FIG. 2 but illustrating a modified form of limited movement hinge mechanism.
Figure 9:
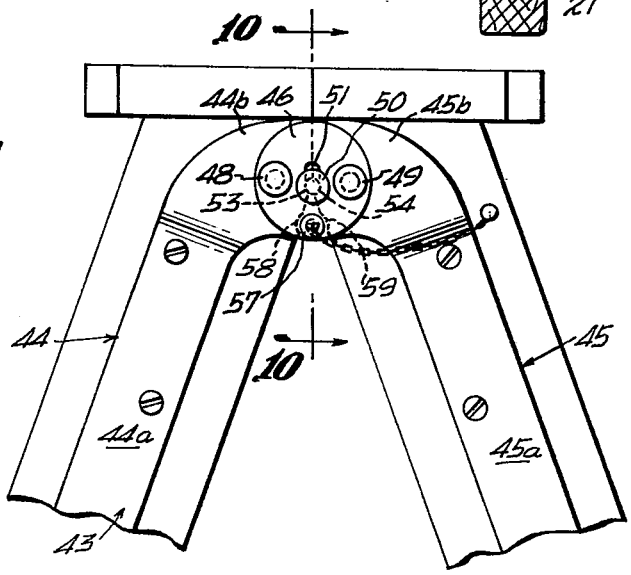

FIG. 9 is a side elevational view similar to that of FIG. 3, but illustrating a hinge mechanism of FIG. 8, with the hinge mechanism opened and with the limited motion locking pin in place to prevent full collapsing of the ladder while walking; and FIG. 10 is a vertical cross-sectional view taken along the line 5—5 of FIG. 9 in the direction of the arrows and illustrating further details of the modified hinge mechanism shown in FIGS. 8 and 9.

Figure 1:
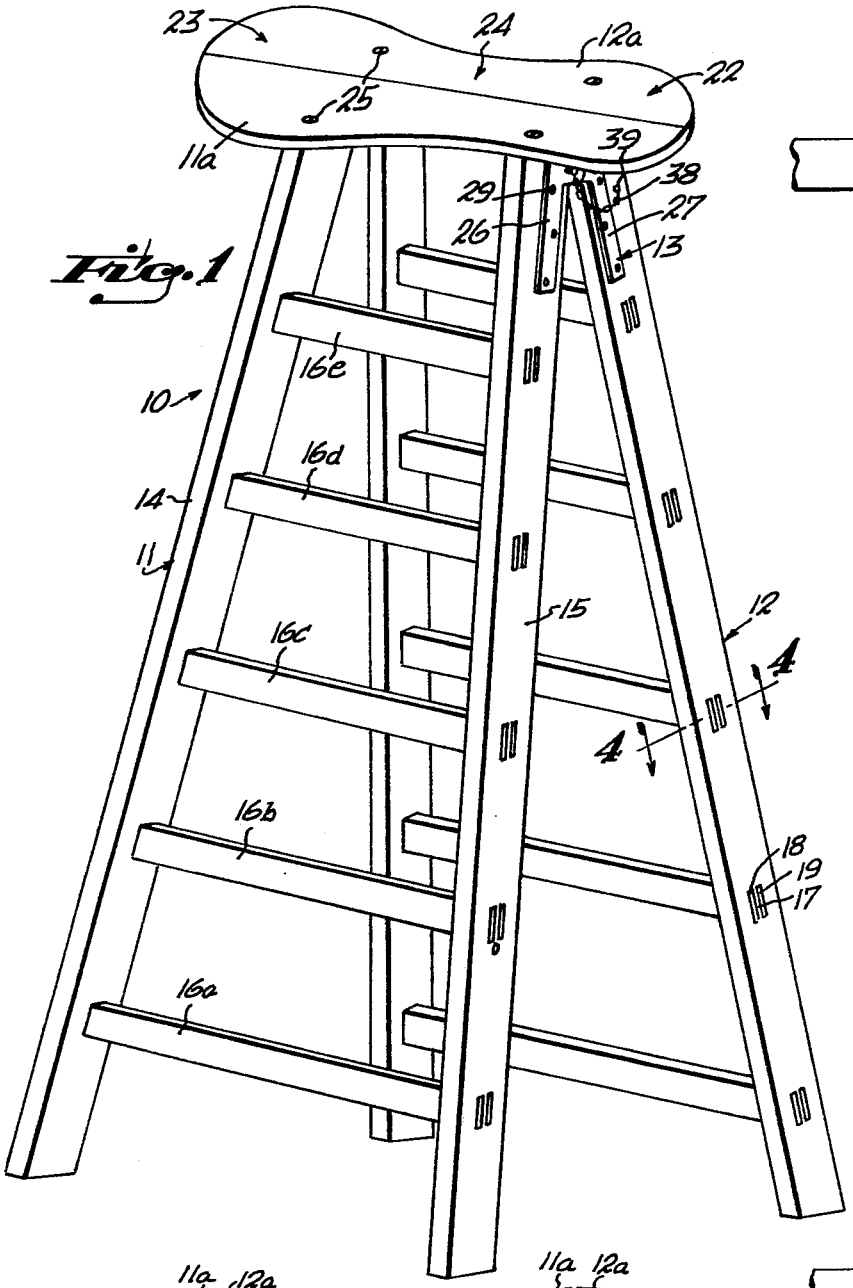
FIG. 1 is a perspective view of one form of walking stepladder embodying the invention, shown in upright and open position.

Referring now in detail to the drawings, reference numeral 10 in FIG. 1 designates, in general, one form of walking stepladder embodying the invention, the same comprising ladder side members 11, 12 hinged together at their upper ends by a pair of opposed hinge members 13 (only one illustrated).

Figure 4:
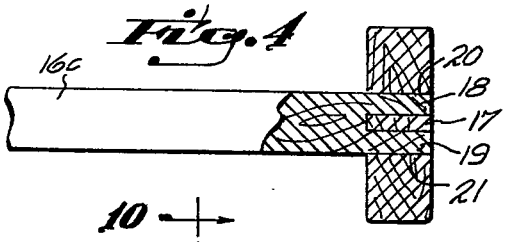
FIG. 4 is a partial cross-sectional view, taken along the line 4—4 of FIG. 1 in the direction of the arrows, illustrating one of the interconnecting joints between a step and slide rail of the ladder.

The ladder side members, except for their ladder top portions 11*a*, 12*a* hereinafter described, are of identical construction, preferably being fabricated of a clear, high-density wood for strength and durability, and comprise side rails 14, 15 interjoined along their length a plurality of equidistantly spaced step members 16*a*, 16*b*, 16*c*, 16*d*, 16*e*, said step members gradually decreasing in length from bottom to top, to provide a relatively broad standing base for the ladder, as is customary in stepladder construction. As illustrated in FIGS. 1 and 4, upper step surfaces of the steps 16*a* through 16*e* are narrow as compared with ordinary step-ladders, and are preferably provided by arranging the stepboards in such a manner that the breadth thereof extends vertically or in parallel relation with respect to the side rails that they join. Thus, because of the narrow step surface desired for walking purposes, as hereinafter described, strength in the steps is afforded by having them deep in a substantially vertical direction. As further illustrated in FIGS. 1 and 4, ladder strength is also enhanced by mortising end portions of the steps 16*a* through 16*e*, as indicated at 17 in FIG. 4, to provide tongue portions 18, 19 closely receivable within complemental rectangular through opening pairs 20, 21 in the latter side rails 14, 15 in which they are glued to ensure a firm and lasting joint.

The ladder top portions 11*a*, 12*a* are identical in construction, being mirror images of one another when assembled in the walking stepladder illustrated in FIG.

1. Together, when the ladder is in its fully extended position of use as is more particularly hereinafter described, they define a substantially flat upper surface of curved peripheral shape having a first arcuate bulge portion 22 at one side and a comparatively large second bulge portion 23 at the opposite side, there being an intermediate, narrow portion 24 which will be straddled by the legs of the user, particularly when walking or standing on the ladder, as is hereinafter more particularly described. The ladder top bulge portions 22, 23 will be used, selectively as desired, for sitting while straddling when in use, or for the support of tools (paint containers and the like) during use of the ladder when in its stationary position. As illustrated in FIG. 3, the ladder top portions 11*a*, 12*a* are so secured at an angle with respect to the upper end of their respective side rail pairs that, when the ladder is in its fully extended position of use, the upper surfaces of the ladder top portions will lie in a common, substantially horizontal plane. The ladder top portions 11*a*, 12*a* will be appropriately secured to their respective side rail pairs, as by wood screws 25.

Figure 5:
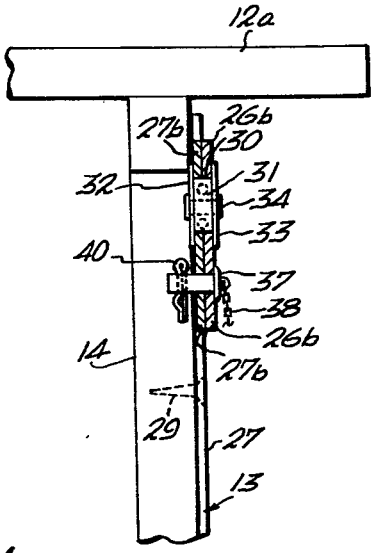
FIG. 5 is a vertical cross-sectional view, taken along the line 5—5 of FIG. 3 in the direction of the arrows, and further illustrating details of the hinge mechanism.

Referring now to FIGS. 1, 2, 3 and 5, and considering the construction and operation of the side hinges members 13, said hinge members each comprise metal hinge leaves 26, 27, stamped or heavy sheet metal, (0.115 inches, for example), said hinge leaves comprising respective leg portions 26*a*, 27*a*, and mutually opposed upper head portions 26*b*, 27*b* respectively. As indicated at 28 in FIGS. 2 and 3, the head portion 26*b* of hinge leaf 26 is outwardly offset with respect to hinge leaf leg portion 26*a* so that hinge assembly head portions 26*b*, 27*b* partially overlap one another at their pivotal juncture, while the leg portions 26*a*, 27*a* lie in a common plane for securement against outside portions of their respective side rails 15, against upper outside portions of which they are secured as by wood screws 29. As illustrated in FIG. 5, the overlapping hinge leaf head portions 26*b*, 27*b* are formed with aligned circular openings 30 closely received within which is a needle bearing 31, said needle bearing being retained in place by a pair of side washers 32, 33 secured in clamping relation there against as by interconnection rivet 34.

Figure 6:
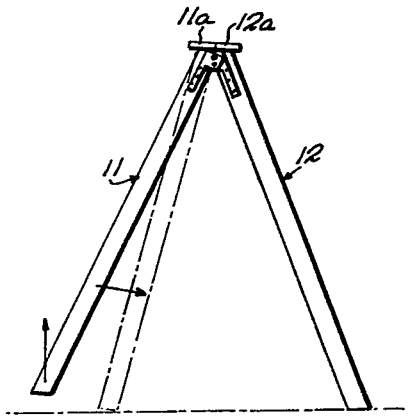
FIGS 6 and 7 illustrate successive movements of the relatively hinged ladder sides as manipulated by a person straddling the ladder from above so that the sides of the ladder are extensions of the legs in taking a sideward step.
Figure 7:
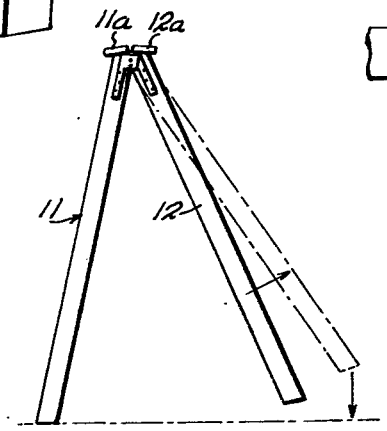

Means is provided for selectively limiting relative outward pivotal movement of the hinge leaves 26, 27 between fully-extended position as illustrated in FIGS. 1 and 6, and partially-extended position as illustrated by the full-line representation thereof in FIG. 7, as in walking the ladder. To this end, the head portion 26*b* of the hinge leaf 26 is provided with a circular opening 36 in circular alignment with an arcuate through slot 35 in the head portion 37*b* of hinge leaf 27. The circular opening 36 and the through slot 35, when the ladder is in any position between fully-opened (as illustrated in FIG. 1) and partially-closed (as in walking, illustrated in FIG. 7), overlap sufficiently to permit insertion therethrough of a headed locking pin 37. The locking pin 27 will preferably have its head attached to a light-weight chain 38, the distal end of which will be appropriately attached to a near-by portion of the ladder side rail, as indicated at 39, to prevent loss. Thus, when the pin 37 is inserted in ladder use, as illustrated in FIG. 5, the ladder sides cannot be brought together for more than a few degrees while walking (see FIGS. 6 and 7) ensuring ladder stability. To protect against either of the pins 37 accidentally falling out during use of the ladder, the inner ends thereof are cross-drilled for the insertion of a spring-retained locking pin 40. With reference to FIG. 3, it is also to be noted that, in addition to limitation of relatively outward movement of the ladder sides afforded by use of headed locking pin 37, the inner edges of the ladder top portions 11*a*, 12*a* also abut one another to limit maximum outward movement.

Referring now to FIGS. 6 and 7, and considering operation of the walking stepladder in sideward walking (to the right, as illustrated), the ladder user straddling the ladder from above while in erect position and facing sidewise will tilt his body to the right to lift the left side of the ladder off the floor, as illustrated by the full-line representation thereof in FIG. 6, while at the same time pressing inwardly with his leg to rotate lifted ladder side portion inwardly to the inward limit position illustrated by the broken-line representation thereof. As illustrated in FIG. 7, the sideward step is then completed by moving body weight to the left, while at the same time, moving the right side of the ladder from the inner limit position illustrated by the full-line representation thereof, to the outer limit position illustrated by the broken-line representation thereof whereupon, after the ladder has again settled to the floor, a step to the right will have been completed. With a little practice, this "walking" of the stepladder, either to one side or the other, can be accomplished easily and safely.

The modification of the invention illustrated in FIGS. 8 through 10 differs from the embodiment illustrated in FIGS. 1 through 7 described above, only in the constructional detail of the hinge 43. As illustrated, hinge 43 which will also preferably be fabricated of sheet metal, comprises a pair of identical hinge leaves 44, 45 having respective leg portions 44*a*, 45*a* and mutually inwardly directed upper head portions 44*b*, 45*b*, respectively. The hinge head portions 44*b*, 44*b* lie in a common plane and are thus constrained by a pair of outer and inner circular washers 46, 47, respectively, (see FIG. 10). A pair of diametrically opposed rivets 48, 49 extending through the washers 46, 47 and through openings in the respective head portions of the hinge leaves 44, 45 serve to clampingly retain said hinge leaves in their common plane disposition, while at the same time permitting rotation about their respective rivets 48, 49. A common pivotal axis about which the hinge leaves 44, 45 turn is established with use of a headed pivot pin 50 extending through central vertical slots 51, 52 in circular washers 46, 47, said pivot pin being embracingly engaged at each side by complemental arcuate recessed portions 53, 54 formed along the opposed edge positions of the hinge upper head portions 44*b*, 45 *b*. It will thus be apparent that while the hinge leaves 44, 45 turn about their respective rivets 48, 49, they are at the same time constrained to relative motion about a common pivotal axis defined by pivot pin 50, which pivot pin necessarily rides up and down within the circular washer slots 51, 52 as said hinge leaves are moved between their inner and outer limit positions. With reference to FIG. 8, it will be seen that inward or collapsing limitation of the hinge is afforded by abutment of lower opposed edge portions of the hinge head portions 44*b*, 45*b*, whereas the maximum outward or fully extended condition of the hinge assembly, as illustrated in FIG. 9, is achieved upon abutment of the upper opposed edge portions of the hinge head portions 44*b*, 45*b*. To provide limited closure for walking of the stepladder as described above, the circular washers 46, 47 are provided, near their lower ends along a vertically extending diameter, with aligned through openings 55, 56 through which a headed locking pin 57 can be inserted. With reference to FIG. 9, it will be understood that insertion of the locking pin 57 allows for only partial closure of the hinge, since the lower, opposed edge portions of the heads thereof will be limited in their relatively inward movement by abutment with peripheral sidewall portions of said locking pin. In order that this abuting contact be firm and stable for safety when walking with the ladder, said hinge head edge portions will preferably be formed with shallow, arcuate recesses 58, 59 complemental in arcuate shape with the periphery of the locking pin 57 at their zones of abutment. The size of the locking pin 57 and the depth of the arcuate recesses 58, 59 will be such as to allow sufficient inward movement of the hinge to provide for walking of the stepladder in the manner illustrated in FIGS. 6 and 7, and as described above. As in the embodiment of the invention illustrated in FIGS. 1 through 7, the hinge pin 57 will also be provided with a light-weight chain attached to a nearby side rail to prevent loss, and a spring-retained locking pin 60 for use in preventing accidental displacement of the locking pin during walking of the ladder.

While I have illustrated and described herein only two forms in which my invention can conveniently be embodied in practice, it is to be understood that these embodiments are presented by way of example and not in a limiting sense. My invention, in brief, comprises all the embodiments and modifications coming within the scope and spirit of the following claims.

What I claim as new and desire to secure by Letters Patent is:

1. A walking stepladder, comprising, in combination, a pair of substantially identical ladder side members, each side member comprising a pair of elongated side rails secured in spaced relation by a plurality of mutually-spaced, transverse step members and a transverse top portion, hinge mechanism joining upper end portions of the side rails of each ladder side member and providing for relative inward and outward pivotal swinging of said ladder side members, said hinge mechanism comprising means limiting relative outward pivotal swinging movement of said ladder side member to a first position of ladder stability, and releaseable means limiting relative inward pivotal movement of said ladder side members with respect to said first limit position, to a second position of ladder stability, thereby providing for safe walking of the ladder by the user when straddling it from above the transverse top portions thereof with the legs supported by opposed step members of said ladder side members.

2. A walking stepladder as defined in claim 1 wherein said hinge mechansim comprises a pair of hinges, each hinge comprising a pair of metal hinge leaves having hinge head portions and hinge leg portions, means pivotally interconnecting the head portions of each hinge, said second position limiting means comprising an abutment pin removably positionable between edge portions of openings in each of said hinge head portions.

3. A walking stepladder as defined in claim 2 wherein said head portions of each of said hinge leaves overlap and wherein said openings comprise an arcuate through slot in one of said head portions and a circular opening in the other of said head portions.

4. A walking stepladder as defined in claim 3 wherein said arcuate through slot and said circular opening comprise said first position limiting means.

5. A walking stepladder as defined in claim 2 wherein said head portions of the hinge leaves of each hinge lie in a common plane and wherein said first position means comprises complemental abutting edge portions of the hinge leaf head portions.

6. A walking stepladder as defined in claim 5 wherein said openings comprise shallow arcuate recesses in complemental edge portions of the hinge leaf heads.

7. A walking stepladder as defined in claim 5 wherein said means pivotally interconnecting the head portions of each hinge comprises a pair of inner and outer washer members overlapping opposite surface portions at each side of said hinge leaf head portions for constraining them to disposition in a common plane, rivet means pivotally interconnecting said washers with each of said hinge head portions, a pair of complemental arcuate pivot pin recesses in edge portions of said hinge head portions, a pair of complemental slots in said washers in registration with said pivot pin arcuate slots, and a headed pivot pin extending through said washer slots and said arcuate pivot pin recesses.

8. A walking stepladder as defined in claim 1 wherein said transverse step members are narrow along their upper stepping surfaces as compared with their width.

9. A walking stepladder as defined in claim 8 wherein the outer end portions of said step members are mortised in complemental openings in said side rails.

10. A walking stepladder as defined in claim 9 wherein said ladder top members lie in a common plane when said ladder side members are in said first position of ladder stability and when in such position define peripheral shape having an arcuate bulge at one end and a comparatively large bulge portion at the other end with a narrow intermediate portion.

* * * * *